US007389866B2

(12) United States Patent
Kawasaki

(10) Patent No.: US 7,389,866 B2
(45) Date of Patent: Jun. 24, 2008

(54) DEVICE AND METHOD FOR REPAIRING MOVING HANDRAIL OF PASSENGER CONVEYOR

(75) Inventor: Atsushi Kawasaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 78 days.

(21) Appl. No.: 10/584,834

(22) PCT Filed: Nov. 30, 2004

(86) PCT No.: PCT/JP2004/017768

§ 371 (c)(1),
(2), (4) Date: Jun. 27, 2006

(87) PCT Pub. No.: WO2006/059364

PCT Pub. Date: Jun. 8, 2006

(65) Prior Publication Data

US 2007/0125476 A1 Jun. 7, 2007

(51) Int. Cl.
*B66B 31/02* (2006.01)

(52) U.S. Cl. ..... 198/335

(58) Field of Classification Search ..... 198/321, 198/335–338

See application file for complete search history.

(56) References Cited

FOREIGN PATENT DOCUMENTS

| | | | |
|---|---|---|---|
| JP | 06-23754 | | 2/1994 |
| JP | 06-34091 | | 9/1994 |
| JP | 8-39695 | | 2/1996 |
| JP | 9-278340 | | 10/1997 |
| JP | 10-111276 | | 4/1998 |
| JP | 11246162 | A * | 9/1999 |
| JP | 2000-16743 | | 1/2000 |
| JP | 2000-211872 | | 8/2000 |
| JP | 2000-289027 | | 10/2000 |
| JP | 2001-039663 | | 2/2001 |
| JP | 3283480 | | 3/2002 |
| JP | 3521234 | | 2/2004 |
| JP | 2005-53687 | | 3/2005 |
| JP | 2007031072 | A * | 2/2007 |
| JP | 2007119125 | A * | 5/2007 |

* cited by examiner

*Primary Examiner*—Mark A Deuble
(74) *Attorney, Agent, or Firm*—Oblon, Spivak, McClelland, Maier & Neustadt, P.C.

(57) ABSTRACT

A moving handrail is provided on a railing of a passenger conveyor. A surface portion of the moving handrail is made of a thermoplastic material. A moving handrail repairing device has heating means for melting the surface portion through heating. When the surface portion is damaged, a target spot to be repaired of the surface portion is melted through heating. After that, the target spot is cured again.

25 Claims, 5 Drawing Sheets

DEVICE AND METHOD FOR REPAIRING MOVING HANDRAIL OF PASSENGER CONVEYOR

TECHNICAL FIELD

The present invention relates to a passenger conveyor employing a moving handrail having a surface portion made of a thermoplastic material, and more particularly, to a device and method for repairing a damaged surface portion of the moving handrail of the passenger conveyor.

BACKGROUND ART

In a conventional passenger conveyor, when its surface portion of a moving handrail is scratched or cracked, the damaged spot is cut out and covered with an unvulcanized rubber material, which is then vulcanized by means of a repair jig (e.g., see Patent Document 1).

Patent Document 1: JP 3283480 A

DISCLOSURE OF THE INVENTION

Problems to be Solved by the Invention

However, according to a conventional moving handrail repairing method described above, a repair operation is quite troublesome. Therefore, even if the degree of the damage is low, the repair has been withheld and the entire moving handrail has been replaced when the damaged spot is extensive.

The present invention is made to solve the problems as described above, and it is an object of the present invention to obtain a device and method for repairing the moving handrail of a passenger conveyor capable of facilitating the repair of the surface portion of the moving handrail.

Means for Solving the Problems

According to the present invention, a device for repairing a moving handrail of a passenger conveyor, the moving handrail having a surface portion made of a thermoplastic material, includes heating means for melting the surface portion through heating.

Further, according to the present invention, a method for repairing a moving handrail of a passenger conveyor, the moving handrail having a surface portion made of a thermoplastic material, includes the steps of: melting a target spot to be repaired of the surface portion through heating; and curing the target spot again.

BEST MODES FOR CARRYING OUT THE INVENTION

Preferred embodiments of the present invention will be described hereinafter with reference to the drawings.

Embodiment 1

Figure 1:
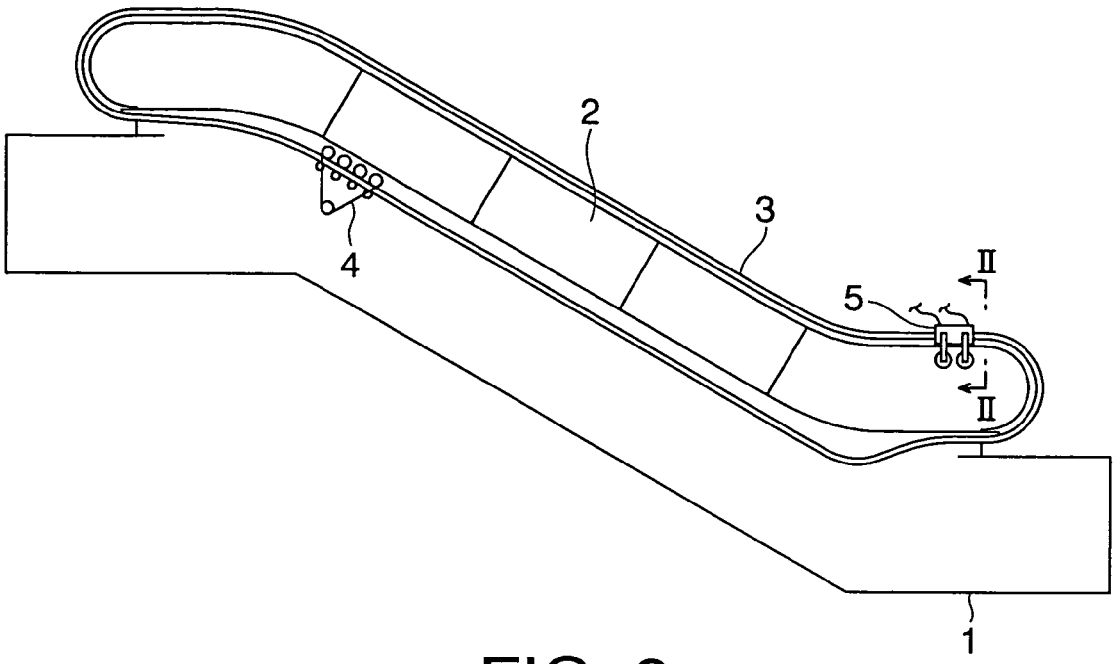
FIG. 1 is a lateral view showing an escalator according to Embodiment 1 of the present invention.

FIG. 1 is a lateral view showing an escalator according to Embodiment 1 of the present invention, showing a state in which an operation of repairing a moving handrail of the escalator is performed. Referring to the figure, a pair of railings 2 are provided upright on a main frame (truss) 1, apart from each other in a width direction of footsteps (not shown). Endless moving handrails 3 are each supported by the railings 2. A handrail driving portion 4 for causing each of the moving handrails 3 to run is provided in a homeward side section of the moving handrails. The moving handrails 3 are each moved in a circulative manner in synchronization with a movement of the footsteps by means of the handrail driving portion 4.

The railings 2 are each provided with a moving handrail repairing device 5 for repairing a corresponding one of the moving handrails 3. The moving handrail repairing device 5 is provided on an outward side linear portion of a path of the moving handrail 3. To be more specific, it is preferable that the moving handrail repairing device 5 be disposed on an upper horizontal portion or a lower horizontal portion of the path of the moving handrail 3. Referring to FIG. 1, the moving handrail repairing device 5 is disposed on the lower horizontal portion.

Figure 2:
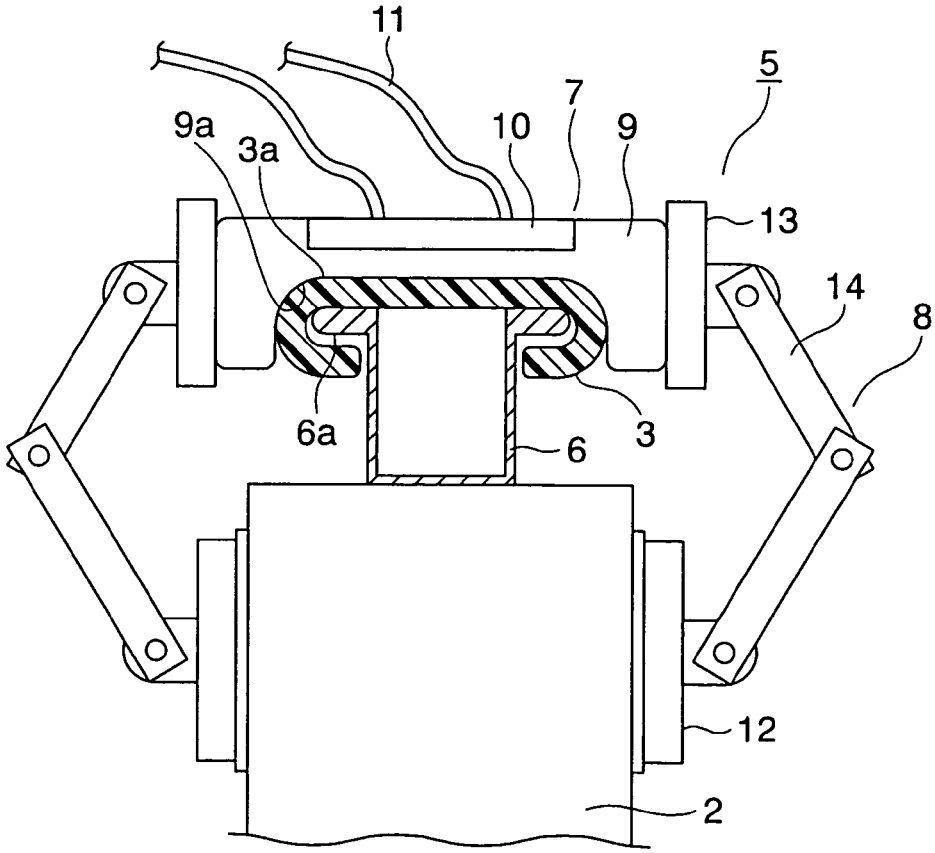
FIG. 2 is a sectional view taken along the line II-II of FIG. 1.

FIG. 2 is a sectional view taken along the line II-II of FIG. 1. In the figure, a handrail guide 6 for guiding the movement of the moving handrail 3 on the outward side of the path of the moving handrail 3 is fixed on an upper portion of the railing 2. The handrail guide 6 is provided, on both sides of an upper end portion thereof, with a pair of flange portions 6*a* engaging an inner surface of the moving handrail 3. At least a surface portion 3*a* of the moving handrail 3 is made of a thermoplastic material such as urethane elastomer or the like.

The moving handrail repairing device 5 has heating means 7 for heating the surface portion 3*a* and fixing means 8 for fixing the heating means 7 to the railing 2. The heating means 7 has a mold 9 bonded to an upper surface and lateral surfaces of the surface portion 3*a* on the outward side of the path of the moving handrail 3, an electric heater 10 for heating the mold 9, and a plurality of cables 11 drawn out from the electric heater 10. The mold 9 is provided with a groove 9*a* into which the moving handrail 3 is inserted. The electric heater 10 is supplied with electric power via the cables 11.

The fixing means 8 has a plurality of magnet portions 12 magnetically adsorbed on an inner surface (lateral surface on a footstep side) and an outer face (lateral surface opposite the footstep side) of the railing 2, a plurality of mold holding portions 13 fixed to the mold 9, and a plurality of flexuous link mechanisms 14 connecting the magnet portions 12 and the mold holding portions 13, respectively.

Next, a method for repairing the moving handrail 3 will be described. A damaged spot, namely, a target spot of the moving handrail 3, which is to be repaired, is moved to the lower horizontal portion and stopped if the target spot is small. The moving handrail repairing device 5 is then fitted to the railing 2 such that the target spot is covered with the mold 9. At this moment, the link mechanisms 14 are flexuous, so the surface portion 3*a* of the moving handrail 3 can be easily brought into close contact with the inner surface of the groove 9*a*. Then, the mold 9 is slightly pressed, because of its own weight, against the surface portion 3*a*.

In this state, the mold 9 is heated by the electric heater 10, thereby heating the moving handrail 3. When the surface portion 3*a* is made of thermoplastic urethane elastomer, a heating temperature of 180° C. to 200° C. is preferred. This is because thermoplastic urethane elastomer starts melting at a temperature of 180° C. to 200° C. If the heating temperature is lower than 180° C., the surface portion 3*a* does not melt sufficiently. If the heating temperature is higher than 200° C., the surface portion 3*a* may increase in fluidity and deform. The heating temperature can be held constant by, for example, providing the heating means 7 with a temperature sensor and controlling the current supplied to the electric heater 10 while monitoring the heating temperature.

By heating the moving handrail 3 as described above, the surface portion 3*a* is appropriately melted, so a scratch on the surface portion 3*a*, a crack in the surface portion 3*a*, or the like is repaired. After that, when the heating by the heating means 7 is stopped to let the surface portion 3*a* cool naturally, the surface portion 3*a* is cured again, thereby completing the repair operation. Alternatively, the surface portion 3*a* may be quickly cured again by previously providing a coolant flow passage in the mold 9 and causing a coolant to flow therethrough after the heating is stopped to forcibly cool the mold 9.

When the surface portion 3*a* has dirt thereon, this dirt is shaved off or scraped off with the aid of sandpaper, chemicals, or the like before repairing by means of the moving handrail repairing device 5. With this operation of removing dirt, the surface portion 3*a* roughens and loses glossiness. However, the surface portion 3*a* can be smoothened again by performing a repair operation by means of the moving handrail repairing device 5 after the dirt has been removed.

In addition, when there are a large number of target spots requiring repair or when a spot requiring repair is extensive, the moving handrail 3 may be caused to run while the surface portion 3*a* is heated by the heating means 7, after the moving handrail repairing device 5 has been fitted to each of the railings 2 as shown in FIG. 1. The spot heated by the heating means 7 is thereby continuously moved in a longitudinal direction of the moving handrail 3, so the surface portion 3*a* can be repaired over the entire length of the moving handrail 3. It is desirable that the running speed of the moving handrail 3 at this moment be lower than a running speed during normal operation, thereby making it possible to sufficiently heat the surface portion 3*a*. Thus, a repair operation mode for causing the footsteps and the moving handrails to run at a sufficiently lower speed than in a normal operation mode may be included among operation modes of a control unit (not shown) for the escalator.

When there is a large scratch on the surface portion 3*a* or a large crack in the surface portion 3*a*, the repair operation may be performed by means of the moving handrail repairing device 5 as described above, after the scratch or the crack has been filled with a thermoplastic material of powder type or paste type.

As described above, the moving handrail repairing device 5 according to Embodiment 1 of the present invention can easily repair the surface portion 3*a* of the moving handrail 3.

The heating means 7 is provided with the mold 9 that is in contact with only the upper surface and the lateral surfaces of the surface portion 3*a*, so a simplification of construction can be achieved. In addition, the mold 9 prevents the surface portion 3*a* from deforming when being melted through heating, thereby making it possible to remold the surface portion 3*a*. Still further, the surface portion 3*a*, which has been repaired, can be smoothened by melting through heating while keeping the mold 9 bonded thereto.

Further, the magnet portions 12 are adsorbed on the railings 2 so that the moving handrail repairing device 5 is fitted to each of the railings 2, so the moving handrail repairing device 5 can be mounted and detached with ease.

Furthermore, the link mechanisms 14 are flexuous, so the heating means 7 can be made to follow vertical and lateral vibrations of the moving handrail 3 in making repair while causing the moving handrail 3 to run.

Still further, the moving handrail repairing device 5 is disposed on the linear portion of the path of the moving handrail 3, so repair can be made without residual stress applied to the surface portion 3*a*, without removing the moving handrail 3 from the railing 2. As a result, the strength and life of the moving handrail 3 can be maintained.

Embodiment 2

Figure 3:
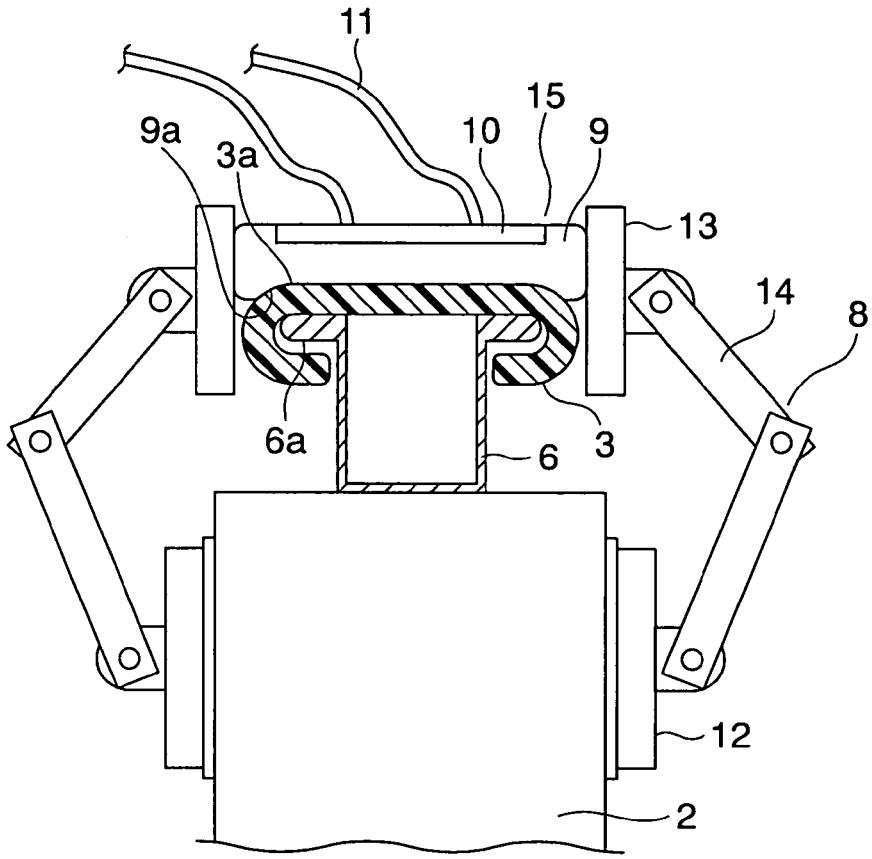
FIG. 3 is a front view showing a moving handrail repairing device according to Embodiment 2 of the present invention.

Next, FIG. 3 is a front view showing a moving handrail repairing device according to Embodiment 2 of the present invention. Referring to the figure, heating means 15 has a mold 16, the electric heater 10, and the cables 11. The mold 16, which assumes the shape of a flat plate, is bonded only to the upper surface of the surface portion 3*a*. Otherwise, Embodiment 2 of the present invention is identical in construction to Embodiment 1 of the present invention.

As described above, the use of the mold 16 assuming the shape of the flat plate also makes it possible to repair the surface portion 3*a* with ease, which is mainly visible from passengers, and to achieve a further simplification in construction.

Embodiment 3

Figure 4:
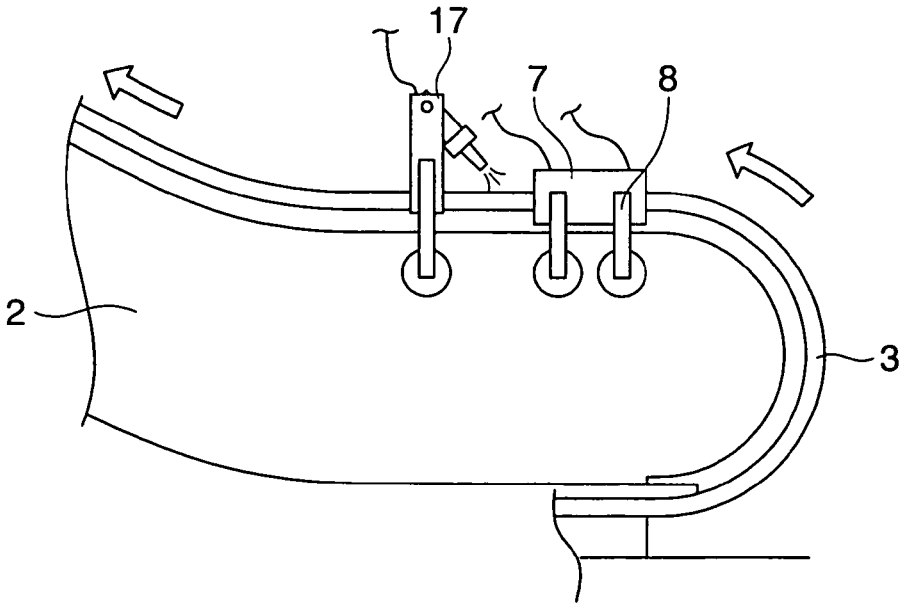
FIG. 4 is a lateral view showing a moving handrail repairing device according to Embodiment 3 of the present invention.

Next, FIG. 4 is a lateral view showing a moving handrail repairing device according to Embodiment 3 of the present invention. In addition to a repairing device main body (moving handrail repairing device 5 in Embodiment 1 of the present invention) composed of the heating means 7 and the fixing means 8, the moving handrail repairing device according to this embodiment has cooling means 17 for cooling the surface portion 3*a* that has been melted through heating by the heating means 7. The cooling means 17 is constructed separately from the repairing device main body, and mounted on the railing 2 apart from the repairing device main body in the longitudinal direction of the moving handrail 3.

When the moving handrail 3 is caused to run in relation to the heating means 7, the cooling means 17 is disposed downstream of the heating means 7 with respect to a moving direction of the moving handrail 3. That is, referring to FIG. 4, when the moving handrail 3 is caused to run in a direction indicated by arrows (ascending direction), the cooling means 1*c*7 is disposed on an upper stand side with respect to the heating means 7.

In addition, examples of the cooling means 17 can include a blower for blowing cool blasts onto the surface portion 3*a*, and the like. A cooler adapted to draw heat from the surface portion 3*a* through direct contact therewith can be employed as well. Otherwise, Embodiment 3 of the present invention is identical in construction to Embodiment 1 of the present invention.

In the moving handrail repairing device constructed as described above, the surface portion 3*a* that has been melted through heating and repaired can be immediately cured again, so the surface portion 3*a* can be prevented from deforming. When the repair operation is performed while causing the moving handrail 3 to run, the softened surface portion 3*a* is more reliably prevented from being deformed by a roller of the handrail driving portion 4.

The cooling means 17 may be mounted on the repairing device main body.

The repairing device main body may be disposed on, for example, the lower horizontal portion of the path of the moving handrail 3, and the cooling means 17 may be disposed on, for example, the upper horizontal portion of the moving handrail 3. Furthermore, the cooling means 17 can also be disposed on an inclined portion or the like of the path of the moving handrail 3.

Embodiment 4

Figure 5:
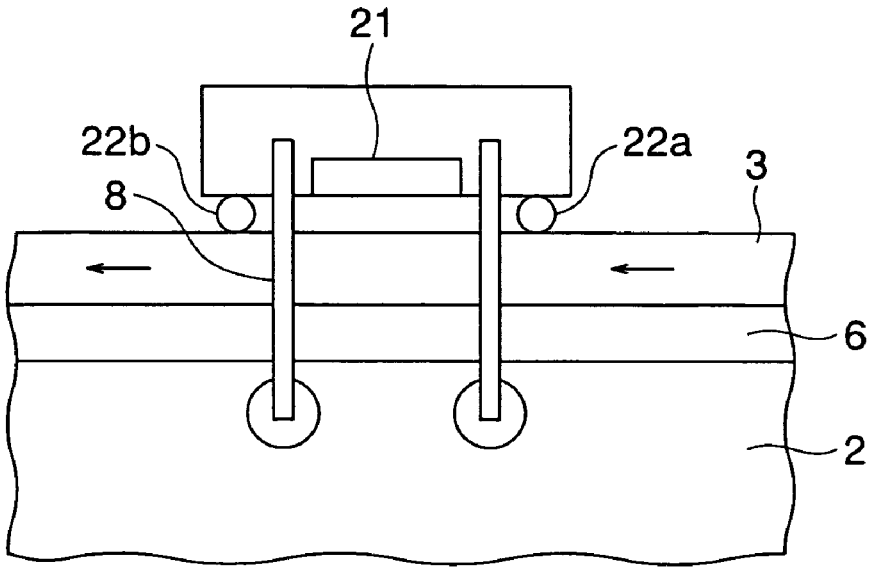
FIG. 5 is a lateral view showing a moving handrail repairing device according to Embodiment 4 of the present invention.

Next, FIG. 5 is a lateral view showing a moving handrail repairing device according to Embodiment 4 of the present invention. The moving handrail repairing device has heating means 21 disposed opposite the surface portion 3*a* to melt it through heating, the fixing means 8 constructed in the same manner as in Embodiment 1 of the present invention, and a pair of spacer rollers 22*a* and 22*b* abutting on the surface portion 3*a* to maintain a predetermined gap between the heating means 21 and the surface portion 3*a*. The spacer rollers 22*a* and 22*b* are rolled with respect to the surface portion 3*a* by causing the moving handrail 3 to run. The heating means 21 is disposed between the spacer rollers 22*a* and 22*b*. In addition, examples of the heating means 21 can include a blower for blowing high-temperature hot blasts onto the surface portion 3*a*, a heater for heating the surface portion 3*a* through radiant heat.

In the moving handrail repairing device constructed as described above, the gap is maintained between the heating means 21 and the surface portion 3*a*, so the repair operation can be performed while causing the moving handrail 3 to run smoothly.

The spacer rollers 22*a* and 22*b* are employed as spacers, so the moving handrail 3 can be moved more smoothly. Moreover, the surface portion 3*a* that has been melted through heating can be smoothened by the spacer roller 22*b*, which is located downstream of the heating means 21 when the moving handrail 3 is caused to run.

Embodiment 5

Figure 6:
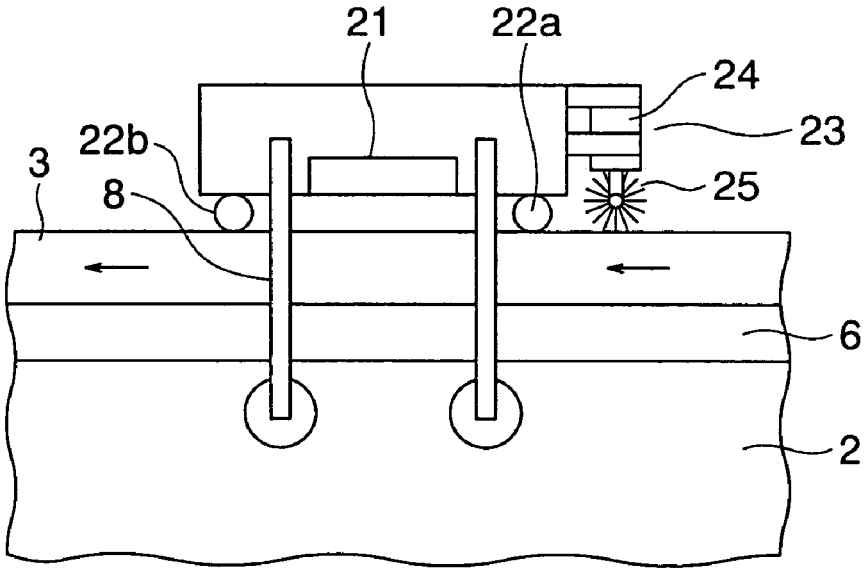
FIG. 6 is a lateral view showing a moving handrail repairing device according to Embodiment 5 of the present invention.

Next, FIG. 6 is a lateral view showing a moving handrail repairing device according to Embodiment 5 of the present invention. The moving handrail repairing device according to Embodiment 5 of the present invention is provided with grinding means 23 for grinding down the surface portion 3*a* before the surface portion 3*a* is heated by the heating means 21. The grinding means 23 has a motor 24 and a rotary brush 25 rotated by the motor 24. The rotary brush 25 can manually or automatically move onto or away from the surface portion 3*a*. By rotating the rotary brush 25 in contact with the surface portion 3*a*, a surface layer of the surface portion 3*a* can be ground. The grinding means 23 is disposed upstream of the heating means 21 with respect to the moving direction of the moving handrail 3. Otherwise, Embodiment 5 of the present invention is identical in construction to Embodiment 4 of the present invention.

In the moving handrail repairing device constructed as described above, when the surface portion 3*a* has dirt thereon, the grinding means 23 grinds down the surface layer of the surface portion 3*a*, thereby making it possible to remove the dirt. At this moment, a large number of tiny scratches are made on the surface portion 3*a*. However, those scratches are remedied during making repair by means of the heating means 21.

The grinding means 23 may be constructed separately from the repairing device main body, and disposed upstream thereof and apart therefrom.

Embodiment 6

Figure 7:
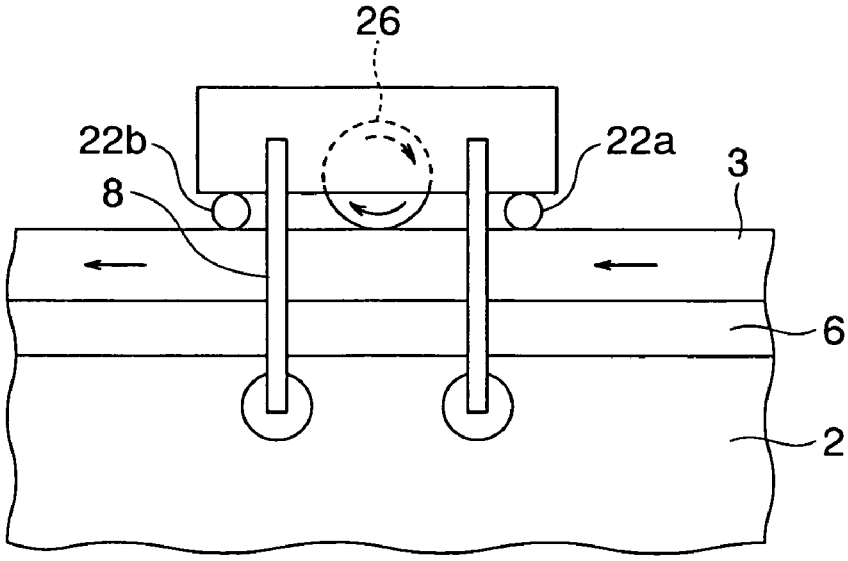
FIG. 7 is a lateral view showing a moving handrail repairing device according to Embodiment 6 of the present invention.

Next, FIG. 7 is a lateral view showing a moving handrail repairing device according to Embodiment 6 of the present invention. In this example, a heating roller 26 for heating the surface portion 3*a* while rolling with respect to the surface portion 3*a* is employed as heating means. The heating roller 26 is a metallic roller having a built-in electric heater.

By employing the heating roller 26 constructed as described above, the surface portion 3*a* can be heated efficiently while the moving handrail 3 is kept in direct contact with the surface portion 3*a* without being prevented from moving, even when the moving handrail 3 is caused to run.

Although the heating roller 26 is illustrated as the only heating roller in FIG. 7, a plurality of heating rollers 26 may be provided instead.

The cooling means 17 according to Embodiment 3 of the present invention may be added to or mounted on each of the moving handrail repairing devices according to Embodiments 4 to 6 of the present invention.

Embodiment 7

Figure 8:
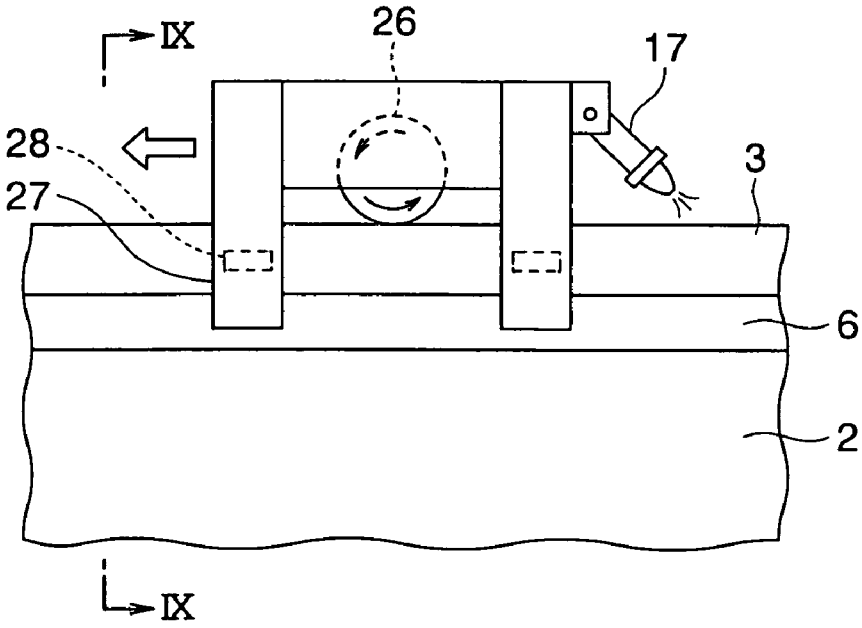
FIG. 8 is a lateral view showing a moving handrail repairing device according to Embodiment 7 of the present invention.
Figure 9:
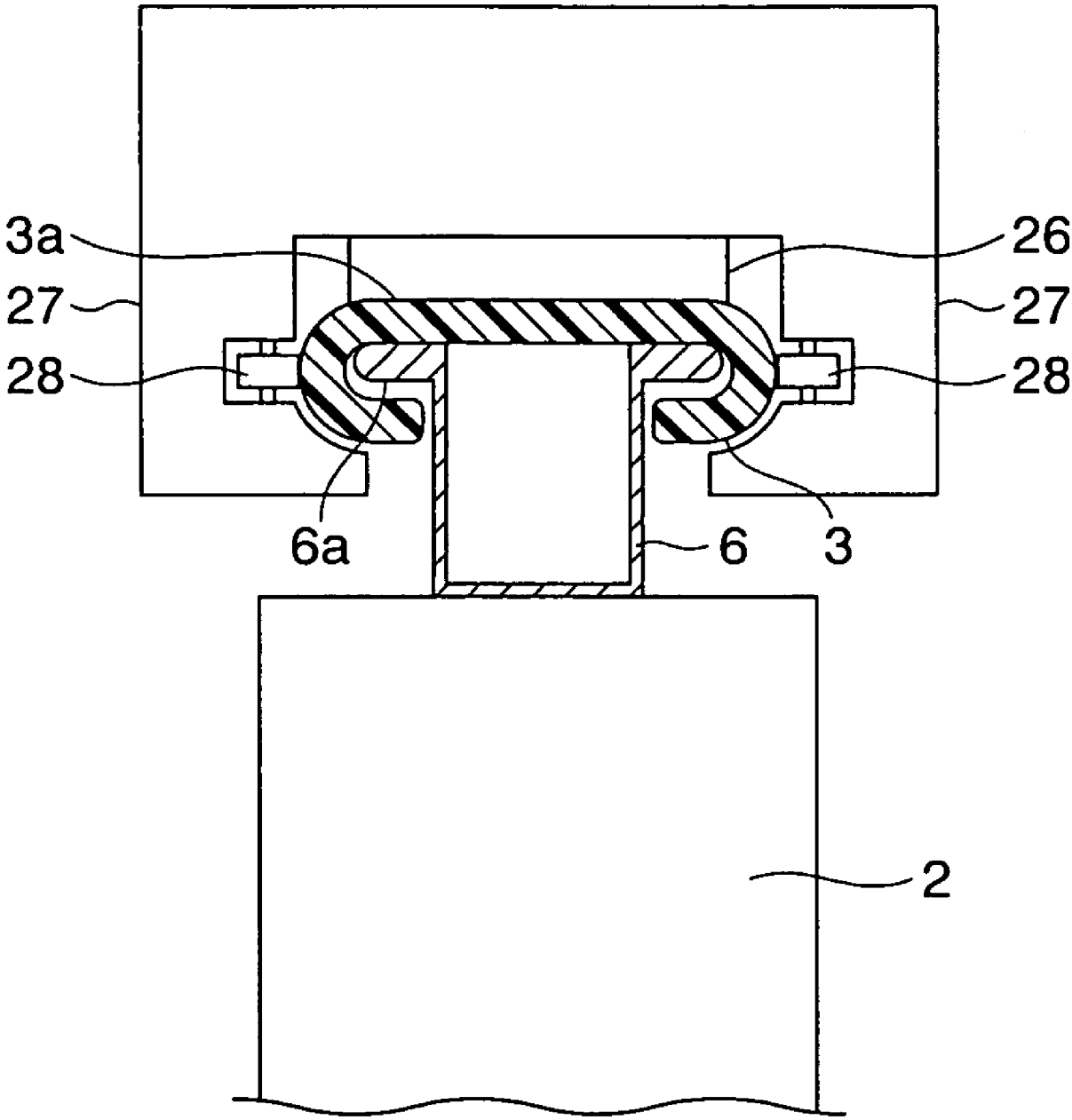
FIG. 9 is a sectional view taken along the line IX-IX of FIG. 8.

Next, FIG. 8 is a lateral view showing a moving handrail repairing device according to Embodiment 7 of the present invention, and FIG. 9 is a sectional view taken along the line IX-IX of FIG. 8. The moving handrail repairing device according to this example is a self-running device that moves with respect to the moving handrail 3 along the longitudinal direction thereof in a state in which the moving handrail 3 is stopped. That is, the moving handrail repairing device has a plurality of gripping arms 27 for gripping the moving handrail 3. The gripping arms 27 are each provided with a drive roller 28 serving as drive means, which rolls along a lateral surface portion of the moving handrail 3. The gripping arms 27 each have a built-in motor (not shown) for driving the drive roller 28.

This moving handrail repairing device is mounted with the same cooling means 17 as in Embodiment 3 of the present invention. The cooling means 17 is disposed downstream of the heating roller 26, namely, at a rear end portion of the moving handrail repairing device.

In the moving handrail repairing device constructed as described above, the moving speed thereof with respect to the moving handrail 3 can be easily adjusted or sufficiently slowed down. In order to sufficiently slow down the moving speed of the moving handrail 3 (to perform ultra low-speed operation) when the moving handrail 3 is caused to run while the moving handrail repairing device is fixed to the railing, a change in a control system of the escalator, which is costly, is required. However, in the self-running moving handrail repairing device, no change on the escalator side is required, so an increase in cost can be prevented.

The moving handrail repairing device is caused to run by the drive roller 28 in Embodiment 7 of the present invention. However, the moving handrail repairing device may be caused to run by the heating roller 26 by transmitting a driving force thereto. In other words, the heating roller can serve as the drive means.

In each of the foregoing embodiments of the present invention, the moving handrail repairing device which is adapted to be fixed to the railing or the self-running moving handrail repairing device has been described. However, the present invention is also applicable to a portable moving handrail repairing device which is adapted to be held by hands of an operator to perform a repair operation.

Moreover, in each of the foregoing embodiments of the present invention, the moving handrail repairing device which is adapted to be mounted only in performing a repair operation has been described. However, a moving handrail repairing device may be permanently installed on, for example, a manual portion or the homeward side of the path of the moving handrail.

Furthermore, although the escalator has been described in each of the foregoing embodiments of the present invention, it goes without saying that the present invention is also applicable to a moving sidewalk.

The invention claimed is:

1. A device for repairing a moving handrail of a passenger conveyor, the moving handrail having a surface portion made of a thermoplastic material, comprising:

heating means for melting the surface portion through heating, and wherein the heating means is a heating roller for heating the surface portion while rolling with respect to the surface portion.

2. The device for repairing a moving handrail of a passenger conveyor according to claim 1, wherein the heating means has a mold capable of being bonded to an upper surface of the surface portion on an onward side of a path of the moving handrail, and an electric heater for heating the mold.

3. The device for repairing a moving handrail of a passenger conveyor according to claim 1, further comprising fixing means having a magnet portion magnetically adsorbed on a railing supporting the moving handrail, for fixing the heating means to the railing.

4. The device for repairing a moving handrail of a passenger conveyor according to claim 1, further comprising cooling means for cooling the surface portion that has been melted through heating by the heating means.

5. The device for repairing a moving handrail of a passenger conveyor according to claim 1, further comprising grinding means for grinding down the surface portion before the surface portion is heated by the heating means.

6. The device for repairing a moving handrail of a passenger conveyor according to claim 1, further comprising a spacer abutting on the surface portion, for maintaining a predetermined gap between the heating means and the surface portion.

7. The device for repairing a moving handrail of a passenger conveyor according to claim 6, wherein the spacer is a spacer roller for rolling with respect to the surface portion.

8. A device for repairing a moving handrail of a passenger conveyor, the moving handrail having a surface portion made of a thermoplastic material, comprising:

heating means for melting the surface portion through heating, and drive means for moving the heating means in a longitudinal direction of the moving handrail.

9. The device for repairing a moving handrail of a passenger conveyor according to claim 8, wherein the heating means has a mold bonded to an upper surface of the surface portion on an onward side of a path of the moving handrail, and an electric heater for heating the mold.

10. The device for repairing a moving handrail of a passenger conveyor according to claim 8, further comprising cooling means for cooling the surface portion that has been melted through heating by the heating means.

11. The device for repairing a moving handrail of a passenger conveyor according to claim 8, further comprising grinding means for grinding down the surface portion before the surface portion is heated by the heating means.

12. The device for repairing a moving handrail of a passenger conveyor according to claim 8, further comprising a spacer abutting on the surface portion, for maintaining a predetermined gap between the heating means and the surface portion.

13. The device for repairing a moving handrail of a passenger conveyor according to claim 12, wherein the spacer is a spacer roller for rolling with respect to the surface portion.

14. A method of repairing a moving handrail of a passenger conveyor, the moving handrail having a surface portion made of a cured thermoplastic material, comprising the steps of:

melting a target spot to be repaired of the surface portion through heating; wherein the heating is performed by a heating roller for heating the surface portion while rolling with respect to the surface portion, and curing the target spot again.

15. The method of repairing a moving handrail of a passenger conveyor according to claim 14, wherein the target spot is heated at a temperature of 180° C. to 200° C.

16. The method of repairing a moving handrail of a passenger conveyor according to claim 14, wherein the target spot is melted through heating after having been moved to a linear portion of a path of the moving handrail.

17. The method of repairing a moving handrail of a passenger conveyor according to claim 14, further comprising the step of removing dirt on the target spot before melting the target spot through heating.

18. The method of repairing a moving handrail of a passenger conveyor according to claim 14, wherein the moving handrail is caused to run while the surface portion is heated so that a heated spot of the surface portion is moved in a longitudinal direction of the moving handrail.

19. The method of repairing a moving handrail of a passenger conveyor according to claim 18, wherein the moving handrail is caused to run at a running speed lower than a running speed during normal operation.

20. A method of repairing a moving handrail of a passenger conveyor, the moving handrail having a surface portion made of a cured thermoplastic material, comprising the steps of:

melting a target spot to be repaired of the surface portion through heating wherein the heating is performed by using a drive means to move the heating device in a longitudinal direction of the moving handrail; by a heating device, and curing the target spot again.

21. The method of repairing a moving handrail of a passenger conveyor according to claim 20, wherein the target spot is heated at a temperature of 180° C. to 200° C.

22. The method of repairing a moving handrail of a passenger conveyor according to claim 20, wherein the target spot is melted through heating after having been moved to a linear portion of a path of the moving handrail.

23. The method of repairing a moving handrail of a passenger conveyor according to claim 20, further comprising the step of removing dirt on the target spot before melting the target spot through heating.

24. The method of repairing a moving handrail of a passenger conveyor according to claim 20, wherein the moving handrail is caused to run while the surface portion is heated so that a heated spot of the surface portion is moved in a longitudinal direction of the moving handrail.

25. The method of repairing a moving handrail of a passenger conveyor according to claim 24, wherein the moving handrail is caused to run at a running speed lower than a running speed during normal operation.

* * * * *